US007844205B2

(12) United States Patent
Matsumoto

(10) Patent No.: US 7,844,205 B2
(45) Date of Patent: Nov. 30, 2010

(54) IMAGE FORMING APPARATUS

(75) Inventor: Hiroyoshi Matsumoto, Ibaraki-Pref (JP)

(73) Assignee: Ricoh Company, Limited, Tokyo (JP)

( * ) Notice: Subject to any disclaimer, the term of this patent is extended or adjusted under 35 U.S.C. 154(b) by 368 days.

(21) Appl. No.: 12/071,722

(22) Filed: Feb. 26, 2008

(65) Prior Publication Data

US 2008/0219720 A1 Sep. 11, 2008

(30) Foreign Application Priority Data

Feb. 26, 2007 (JP) ..... 2007-045102

(51) Int. Cl.
*G03G 15/01* (2006.01)

(52) U.S. Cl. ..... 399/299

(58) Field of Classification Search ..... 399/66, 399/121, 297, 299, 308
See application file for complete search history.

(56) References Cited

U.S. PATENT DOCUMENTS 5,365,324 A * 11/1994 Gu et al. ..... 399/299

FOREIGN PATENT DOCUMENTS

JP 2005-266269 9/2005

* cited by examiner

*Primary Examiner*—David M Gray
*Assistant Examiner*—Rodney Bonnette
(74) *Attorney, Agent, or Firm*—Harness, Dickey & Pierce, P.L.C.

(57) ABSTRACT

A moving unit is made to perform a contacting operation at least two times. The contacting operation includes relatively moving an endless belt and an image carrier so that the endless belt and the image carrier to come in contact with each other.

13 Claims, 3 Drawing Sheets

IMAGE FORMING APPARATUS

CROSS-REFERENCE TO RELATED APPLICATIONS

The present application claims priority to and incorporates by reference the entire contents of Japanese priority document 2007-045102 filed in Japan on Feb. 26, 2007.

BACKGROUND OF THE INVENTION

1. Field of the Invention

The present invention relates to an image forming apparatus.

2. Description of the Related Art

A typical electrophotographic full-color image forming apparatus includes four image forming units that respectively form yellow (Y), magenta (M), cyan (C), and black (BK) toner images. Each of the toner images formed on a surface of an image carrier included in each of the image forming units is primary-transferred onto a surface of an intermediate transfer belt sequentially in a superimposed manner thereby obtaining a full-color toner image. Subsequently, the full-color toner image on the surface of the intermediate transfer belt is secondary-transferred onto a recording medium by a secondary transfer unit such as a transfer roller. In some image forming apparatuses, see, for example, Japanese Patent Application Laid-open No. 2005-266269, an intermediate transfer belt and each of image carriers are made to come in contact with each other only when performing the primary-transfer, and are separated from each other when not performing the primary-transfer for various reasons. Such a configuration makes it possible to improve the durability of the intermediate transfer belt.

An intermediate transfer belt is typically supported by supporting rollers. If an image forming apparatus is not in use for a long time, imprinted marks of the supporting rollers are left on portions of the intermediate transfer belt where the intermediate transfer belt is supported by the supporting rollers. A toner image will be distorted if it is formed on an imprinted mark. FIG. 6 is a schematic diagram of an example of an intermediate transfer belt 115 with two imprinted marks 117. The imprinted marks 117 are generally a few tens of micrometers to a few hundreds of micrometers high depending on curvatures of supporting rollers 120, 121, and the tension on the intermediate transfer belt 115. In some image forming apparatuses, the intermediate transfer belt is supported by three supporting rollers. In other word, the intermediate transfer belt is formed into a triangular shape in a side view. However, an image forming apparatus in which an intermediate transfer belt is supported by three supporting rollers is costlier and bigger than the one in which an intermediate transfer belt is supported by two supporting rollers.

SUMMARY OF THE INVENTION

It is an object of the present invention to at least partially solve the problems in the conventional technology.

According to an aspect of the present invention, there is provided an image forming apparatus including an image carrier on which a toner image is formed; an endless belt that is supported by a plurality of supporting members; a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving any one of the endless belt and the image carrier to cause the endless belt and the image carrier to be separated from each other; and a control unit that controls the moving unit. The control unit controls the moving unit so as to perform the separating operation when an image is not to be formed on the image carrier, and controls the moving unit so as to perform, when an image is to be formed, the contacting operation a plurality of times before the transfer unit starts transferring the toner image.

According to another aspect of the present invention, there is provided an image forming apparatus including an image carrier on which a toner image is formed; an endless belt that is supported by a plurality of supporting members; a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving the endless belt and the image carrier to cause the endless belt and the image carrier to be separated from each other; and a control unit that controls the moving unit and movement of the endless belt. The control unit, when an image is not to be formed on the image carrier, controls the moving unit so as to perform the separating operation, and when an image is to be formed, controls movement of the endless belt so as to temporarily stop the endless belt after the endless belt has moved a predetermined distance and then controls the moving unit so as to perform the contacting operation, before the transfer unit starts transferring the toner image.

According to another aspect of the present invention, there is provided an image forming apparatus including an image carrier on which a toner image is formed; an endless belt that is supported by a plurality of supporting members; a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving the endless belt and the image carrier to cause the endless belt and the image carrier to be separated from each other; and a control unit that controls the moving unit and movement of the endless belt. The control unit, when an image is not to be formed on the image carrier, controls the moving unit so as to perform the separating operation, and when an image is to be formed, controls movement of the endless belt so as to temporarily move the endless belt at a speed lower than normal speed of the endless belt and then controls the moving unit so as to perform the contacting operation, before the transfer unit starts transferring the toner image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
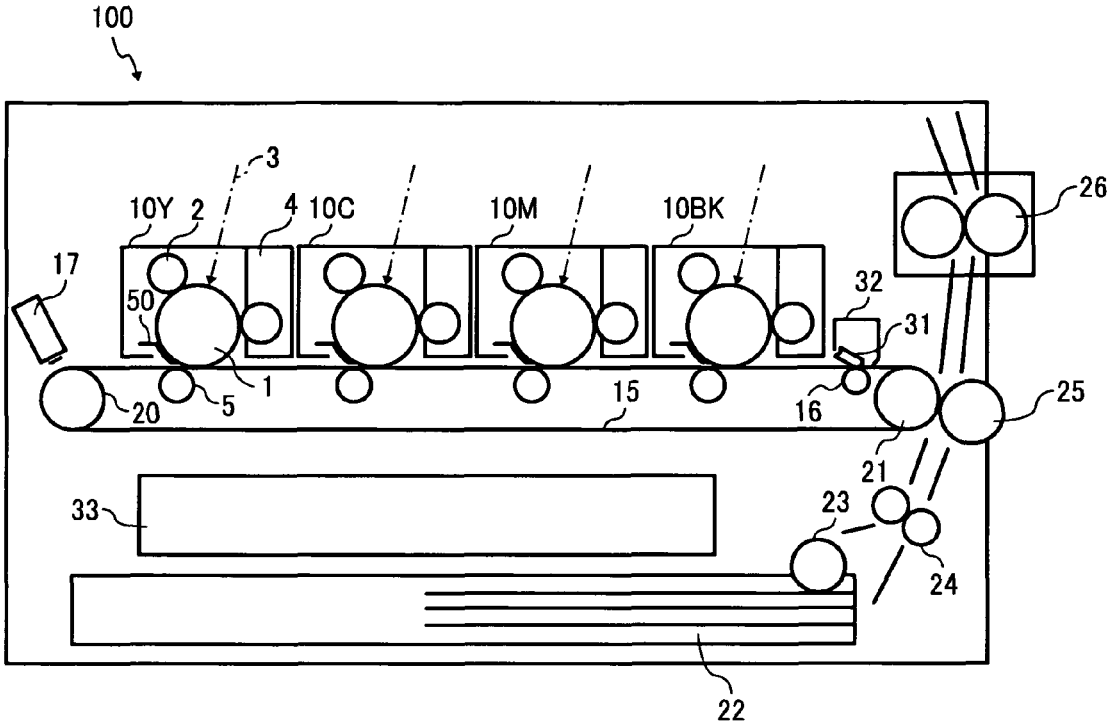
FIG. 1 is a schematic diagram of an image forming apparatus according to a first embodiment of the present invention.

FIG. 1 is a schematic diagram of a tandem image forming apparatus 100 according to a first embodiment of the present invention. The image forming apparatus 100 employs an intermediate transfer method. The image forming apparatus 100 includes a process unit 10 including four process units 10Y, 10C, 10M, and 10BK, an exposure unit 3, an intermediate transfer belt 15, a tension roller 20, a secondary transfer roller 21, a secondary transfer roller 25, four primary transfer rollers 5, a cleaning roller 16, a sensor 17, a cleaning unit 32, a waste-toner container 33, a feed roller 23, a pair of registration rollers 24, a fixing unit 26, and four moving units 40 (see FIG. 2). Each of the process units 10Y, 10C, 10M, and 10BK includes a photosensitive drum 1 as an image carrier, a charging unit 2, a developing unit 4, and a cleaning unit 50.

The photosensitive drum 1 has the diameter of 24 millimeters, and it rotates in a clockwise direction at a circumferential speed of 120 millimeters per second. The charging unit 2 is in the form of a roller, and it is pressed against the surface of the photosensitive drum 1. When the photosensitive drum 1 rotates, the charging unit 2 receives torque from the photosensitive drum 1 and it also rotates. The charging unit 2 applies a bias voltage of about −1000 volts uniformly on the surface of the photosensitive drum 1. After that, the exposure unit 3 forms an electrostatic latent image corresponding to image data on the surface of the photosensitive drum 1. In the first embodiment, an optical unit having a laser diode (LD) is employed as the exposure unit 3. Alternatively, a light-emitting diode (LED) can be used instead of the laser diode.

The developing unit 4 develops the electrostatic latent image on the photosensitive drum 1 into a toner image. Specifically, the developing unit 4 contains therein a nonmagnetic single-component toner (not shown), and includes a developing roller. A developing bias voltage is applied to the surface of the developing roller so that the toner electrostatically sticks to the developing roller. The toner on the developing roller then shifts to the electrostatic latent image on the photosensitive drum 1 thereby developing the electrostatic latent image into a toner image. The process units 10Y, 10C, 10M, and 10BK are aligned in this order from the left to the right, and form yellow (Y), magenta (M), cyan (C), and black (BK) toner images, respectively, on corresponding one of the photosensitive drums 1.

The toner images on the photosensitive drums 1 are sequentially transferred onto the intermediate transfer belt 15 in a superimposed manner, resulting in formation of a full-color toner image on the intermediate transfer belt 15. After the toner image is transferred onto the intermediate transfer belt 15, the cleaning unit 50 removes a residual toner from the surface of the intermediate transfer belt 15. When the process unit 10 is not in operation, the moving unit 40 moves the intermediate transfer belt 15 so that the intermediate transfer belt 15 is separated from the photosensitive drums 1 in the process unit 10. The intermediate transfer belt 15 is supported and tensed by the tension roller 20, the secondary transfer roller 21, the primary transfer rollers 5, and the cleaning roller 16. A drive motor (not shown) drives the secondary transfer roller 21 so that the intermediate transfer belt 15 is driven to move in a counterclockwise direction at the same speed as the photosensitive drums 1. The intermediate transfer belt 15 is made of thermoplastic elastomer having a volume resistivity of $10^7$ Ω·cm to $10^{11}$ Ω·cm and a surface resistivity of $10^7$ Ω/sq to $10^{11}$ Ω/sq (measured by Hiresta-up MCP-HT450 manufactured by Mitsubishi Chemical Corporation with an applied voltage of 500V/10 s).

The primary transfer roller 5 is arranged to be opposed to the photosensitive drum 1 across the intermediate transfer belt 15 with predetermined shifts in a moving direction of the intermediate transfer belt 15 and in a vertically upward direction. Specifically, a central axis of the primary transfer roller 5 is shifted by 8 millimeters from that of the photosensitive drum 1 in a moving direction of the intermediate transfer belt 15, and also shifted by 1 millimeter in a vertically upward direction. Therefore, when the intermediate transfer belt 15 has contact with the photosensitive drum 1, the intermediate transfer belt 15 can be partially wound around the photosensitive drum 1, so that the toner image on the photosensitive drum 1 can be effectively transferred onto the intermediate transfer belt 15.

Each of the primary transfer rollers 5 applies the same bias voltage in the range of +500 volts to +1000 volts to corresponding one of the photosensitive drums 1 via the intermediate transfer belt 15. Thus, a transfer electric field is present between the two. Because of the action of the transfer electric field, the toner image is transferred from the photosensitive drum 1 onto the intermediate transfer belt 15. Incidentally, in the first embodiment, 20-millimeter-diameter rollers are used as the tension roller 20 and the secondary transfer roller 21, and the surface of the secondary transfer roller 21 is coated with a 50-micrometer thick polyurethane layer.

A toner amount and a position of each of the toner images transferred onto the intermediate transfer belt 15 are measured based on a combination of a specular reflection factor and a diffuse reflection factor with the sensor 17. Depending on a result of the measurement, an image density and a misalignment of the toner images are adjusted. The cleaning unit 32 includes a cleaning blade 31 that abuts with the intermediate transfer belt 15 and runs counter to the moving direction of the intermediate transfer belt 15. The cleaning blade 31 removes residual toners from the surface of the intermediate transfer belt 15 after the toner images are transferred onto a transfer sheet 22. The residual toners removed by the cleaning unit 32 are conveyed to and accumulated in the waste-toner container 33.

As the secondary transfer roller 25, such a roller that a metal core bar of 20 millimeters in diameter is coated with a polyurethane elastic member having a resistance of $10^6\Omega$ to $10^{10}\Omega$ adjusted by an electrically-conductive material and an Asker-C hardness of 35 degrees to 50 degrees is used. One of the transfer sheets 22 is lifted by the feed roller 23 and fed to the registration rollers 24. The registration rollers 24 convey the transfer sheet 22 to a nip portion between the secondary transfer rollers 21 and 25 at a timing when a leading end of the full-color toner image on the surface of the intermediate transfer belt 15 comes to the nip portion. By the application of a predetermined transfer bias from the metal core bar of the secondary transfer roller 25 to the transfer sheet 22, the full-color toner image on the intermediate transfer belt 15 is secondary-transferred onto the transfer sheet 22. The fixing unit 26 fixes the full-color toner image on the transfer sheet 22. After that, the transfer sheet 22 is discharged from the image forming apparatus 100.

Figure 2:
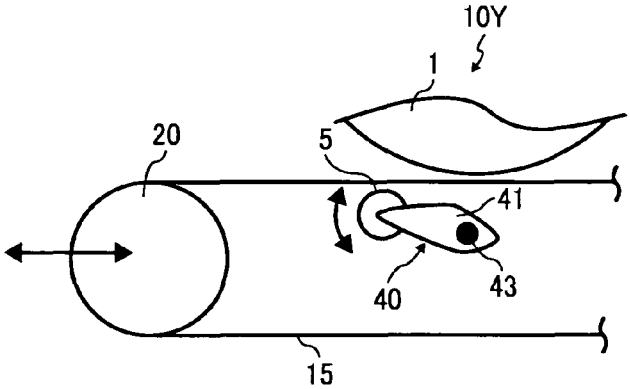
FIG. 2 is a schematic diagram of a moving unit shown in FIG. 1.

FIG. 2 is a schematic diagram of the moving unit 40 corresponding to the process unit 10Y. The moving units 40 corresponding to the process units 10C, 10M, 10BK have the same or similar configuration as that is shown in FIG. 2. As shown in FIG. 2, the moving unit 40 is connected to the primary transfer roller 5. The primary transfer roller 5 is arranged to be opposed to the photosensitive drum 1 across the intermediate transfer belt 15. The moving unit 40 includes two arm-shaped primary-transfer moving members 41. One end of each of the primary-transfer moving members 41 is rotatable around a supporting point 43, and the other end is coupled to a corresponding end of the primary transfer roller 5. The primary transfer roller 5 can be moved toward or away from the photosensitive drum 1 by oscillation of the primary-transfer moving members 41 around the supporting points 43. The oscillation of the primary-transfer moving members 41 is caused by the action of a clutch (not shown) and a spring (not shown). When the primary transfer roller 5 moves toward the photosensitive drum 1, the primary transfer roller 5 applies tension to the intermediate transfer belt 15 and presses the intermediate transfer belt 15 against the photosensitive drum 1. At this time, to prevent the intermediate transfer belt 15 from being stretched due to the tension applied by the primary transfer roller 5, the tension roller 20 is moved toward the secondary transfer roller 21 (see FIG. 1).

When the process unit 10 is not in operation, a control unit (not shown) performs a separating operation. That is, it controls the moving unit 40 so as to move the primary transfer roller 5 away from the photosensitive drums 1, i.e., to separate the intermediate transfer belt 15 from the photosensitive drums 1. When the process unit 10 is in operation, the control unit performs a contacting operation. That is, the it controls the moving unit 40 so as to move the primary transfer roller 5 toward the intermediate transfer belt 15, i.e., to have the intermediate transfer belt 15 contact with the photosensitive drums 1.

As explained above, in some image forming apparatuses, an intermediate transfer belt is supported and tensed by three supporting rollers, and formed into a substantially triangular shape to make a curvature of each apex of the triangular-shaped intermediate transfer belt smaller than the curvature of the corresponding supporting roller. On the other hand, in the image forming apparatus 100, although the intermediate transfer belt 15 is supported and tensed by a plurality of the rollers as shown in FIG. 1, the intermediate transfer belt 15 is mainly supported and tensed by only two rollers (hereinafter, "the supporting rollers"): the tension roller 20 and the secondary transfer roller 21. This configuration makes it possible to reduce the cost and the size of the image forming apparatus, however, increases the curvatures of the apexes at the supporting rollers as compared with the one in which intermediate transfer belt is supported and tensed by three supporting rollers. Therefore, if the image forming apparatus is not in use for a long time, i.e., the intermediate transfer belt 15 is stretched over the supporting rollers in one position for a long time, imprinted marks of the supporting rollers are left on the intermediate transfer belt 15. When the image forming apparatus does not have enough time to recover the intermediate transfer belt 15 from the imprinted marks, the intermediate transfer belt 15 cannot be partially wound around the photosensitive drum 1 properly at a primary transfer nip portion between the photosensitive drum 1 and the primary transfer roller 5.

To take care of this issue, in the image forming apparatus 100, the control unit controls the moving unit 40 so as to press the primary transfer roller 5 against the intermediate transfer belt 15 to apply tension to the intermediate transfer belt 15 to the extent that the intermediate transfer belt 15 comes in contact with the photosensitive drum 1, and repeats this operation two times. That is, the control unit controls the moving unit 40 to perform the contacting operation two times.

Figure 3A:
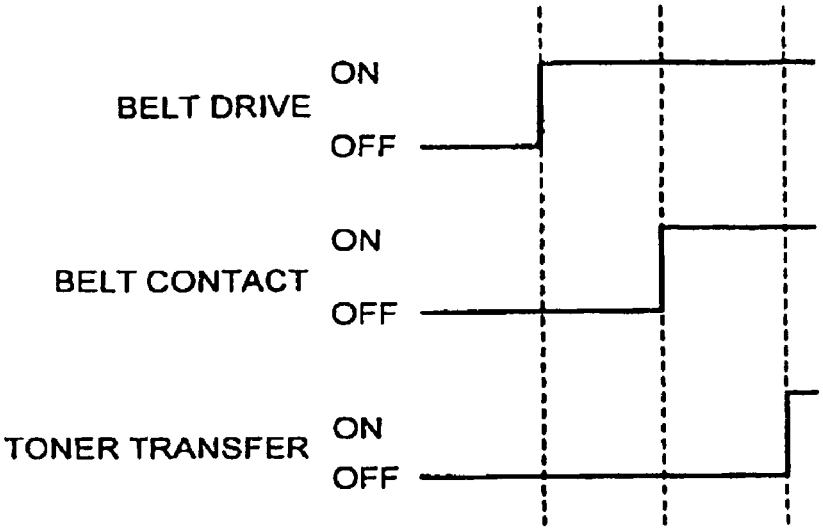
FIG.3A PRIOR ART
FIG. 3A is a timing diagram for explaining movement of an intermediate transfer belt of an image forming apparatus according to a conventional technology.
Figure 3B:
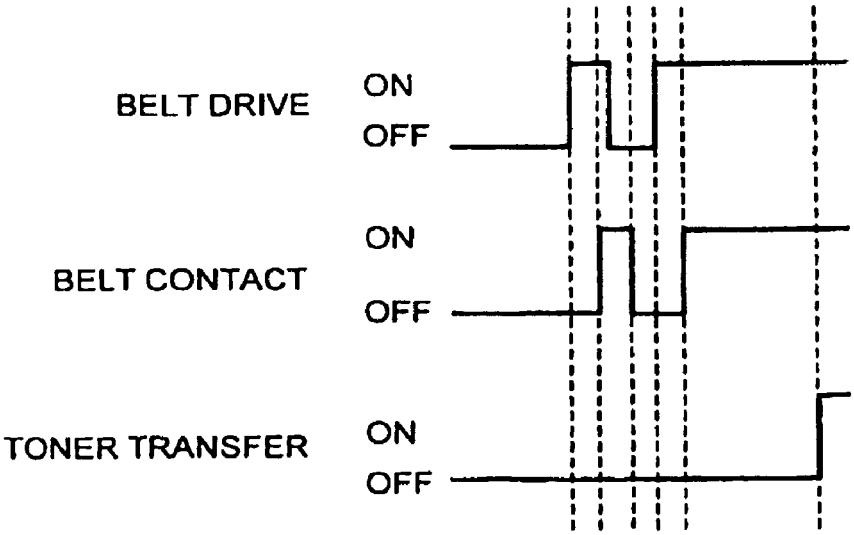
FIG. 3B is a timing diagram for explaining an example of movement of an intermediate transfer belt shown in FIG. 1.

In the conventional image forming apparatus, as shown in FIG. 3A, the intermediate transfer belt is moved only once, i.e., the contacting operation performed only once. On the other hand, in the image forming apparatus 100, as shown in FIG. 3B, the intermediate transfer belt 15 is moved two times, i.e., the contacting operation performed two times. Because tension is applied to the intermediate transfer belt 15 two times, the intermediate transfer belt 15 is stretched so that any imprinted marks left on the intermediate transfer belt 15 are made flat or "obscure".

In the first embodiment, the second contacting operation is performed when an imprinted mark on the intermediate transfer belt 15 comes between the process units 10C and 10M. The imprinted marks of the supporting rollers are left on contact surfaces of the intermediate transfer belt 15 because the maximum tension is applied to the contact surfaces by the supporting rollers. Therefore, the first contacting operation is performed, the separating operation is performed, the intermediate transfer belt 15 is moved in the moving direction, and finally the second contacting operation is performed. Namely, contact surfaces of the intermediate transfer belt 15 with the supporting rollers in the second contacting operation are different from those are in the first contacting operation, so that portions of the intermediate transfer belt 15 nearby the imprinted marks are tensed during the second contacting operation. Therefore, it is possible to recover the intermediate transfer belt 15 from the imprinted marks more effectively. As a result, it is possible to make the imprinted marks flat, and thus the density unevenness of the print image can be reduced.

Particularly, if the second contacting operation is performed when a moving distance of the intermediate transfer belt 15 is about 30 millimeters corresponding to a semiperimeter of each of the supporting rollers (20 millimeters in diameter times pi equals about 60 millimeters in perimeter), the imprinted marks can be eliminated almost entirely. If the intermediate transfer belt 15 keeps on moving with having contact with the photosensitive drum 1, the supporting rollers have little time to tense portions of the intermediate transfer belt 15 on which the imprinted marks are left even though the moving distance of the intermediate transfer belt 15 is about 30 millimeters. Therefore, when the intermediate transfer belt 15 moves about 30 millimeters, the intermediate transfer belt 15 is stopped temporarily so that the supporting rollers can have enough time to tense the intermediate transfer belt 15.

Even when it is only for three seconds that the intermediate transfer belt 15 is tensed by the supporting rollers, the imprinted marks can be made flat in an effective manner. Incidentally, "OFF" of the belt drive shown in FIG. 3B indicates that the intermediate transfer belt 15 is not moving, and "ON" indicates that the intermediate transfer belt 15 is moving.

Figure 4:
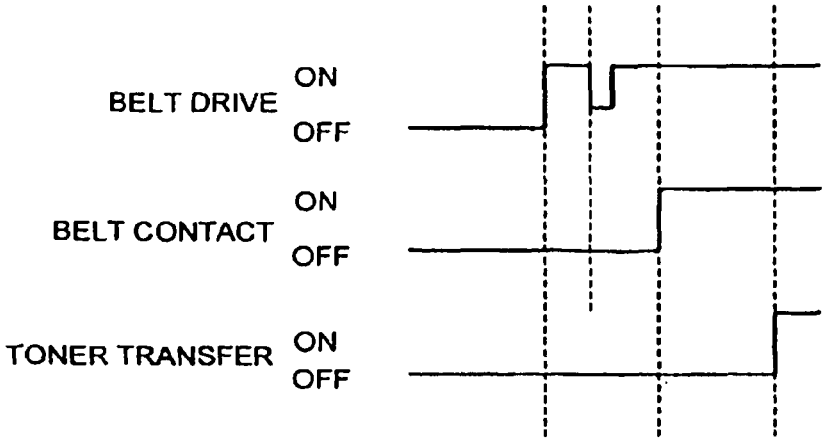
FIG. 4 is a timing diagram for explaining another example of movement of the intermediate transfer belt shown in FIG. 1.

However, such stopping of the intermediate transfer belt 15, be it for three seconds, will lengthen the printing time, which is against the general needs, i.e., reduction in the printing time. To take care of this issue, instead of temporarily stopping the intermediate transfer belt 15, as shown in FIG. 4, the intermediate transfer belt 15 can be driven to move at half of the normal speed. Even with such configuration, the imprinted marks can be made flat in an effective manner. Incidentally, when a level of the belt drive indicates between "ON" and "OFF" as shown in FIG. 4, the moving speed of the intermediate transfer belt 15 is reduced by half.

As described above, the imprinted marks left on the intermediate transfer belt 15 can be made flat by performing the contacting operation a plurality of times when the moving distance of the intermediate transfer belt 15 is about 30 millimeters. Therefore, the intermediate transfer belt 15 is come in contact with the photosensitive drum 1 when the intermediate transfer belt 15 moves about 30 millimeters from a position at the first-time contact movement so that the portions of the intermediate transfer belt 15 nearby the imprinted marks are tensed by the supporting rollers with the maximum tension. As a result, the imprinted marks left on the intermediate transfer belt 15 can be made flat.

In the first embodiment, the intermediate transfer belt 15 is stopped temporarily before performing the second contacting operation. Alternatively, the intermediate transfer belt 15 can be driven to move at half of the normal moving speed until the intermediate transfer belt 15 moves up to about 30 millimeters after the first contacting operation. Even in this case, the imprinted marks left on the intermediate transfer belt 15 can be made flat.

Although the first embodiment has been applied to a configuration in which an intermediate transfer belt is supported and tensed by two rollers, it is possible to apply the first embodiment to a configuration in which an intermediate transfer belt is supported and tensed by three or more rollers. Even in the configuration in which an intermediate transfer belt is supported and tensed by three or more rollers, the intermediate transfer belt is stopped temporarily when the intermediate transfer belt moves a distance substantially corresponding to a semiperimeter of each of the supporting rollers, or is driven to move at a lower speed until the intermediate transfer belt moves up to the distance substantially corresponding to the semiperimeter of each of the supporting rollers between the first contacting operation and the second contacting operation.

In this manner, the imprinted marks left on the intermediate transfer belt 15 can be made flat with simple operation. In addition, it is possible to reduce the cost and the size of the image forming apparatus.

Figure 5:
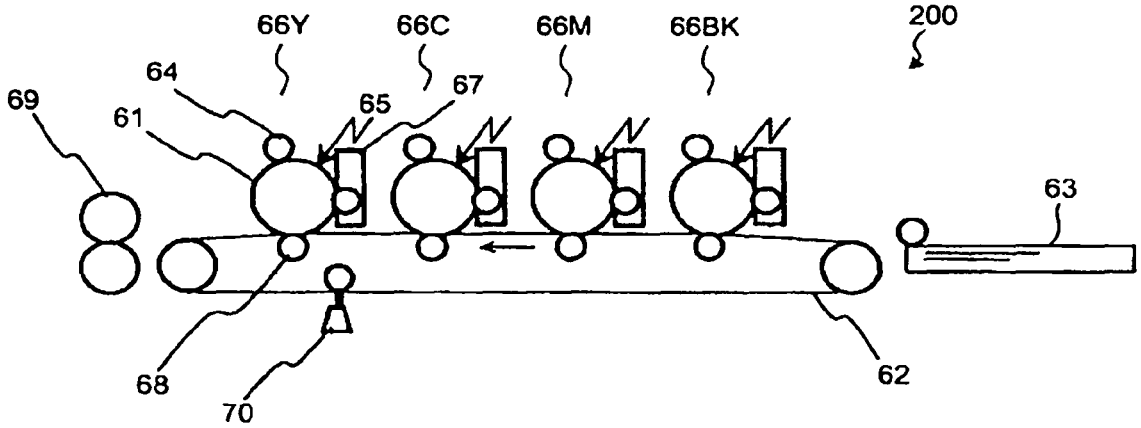
FIG. 5 is a schematic diagram of an image forming apparatus according to a second embodiment of the present invention.
Figure 6:
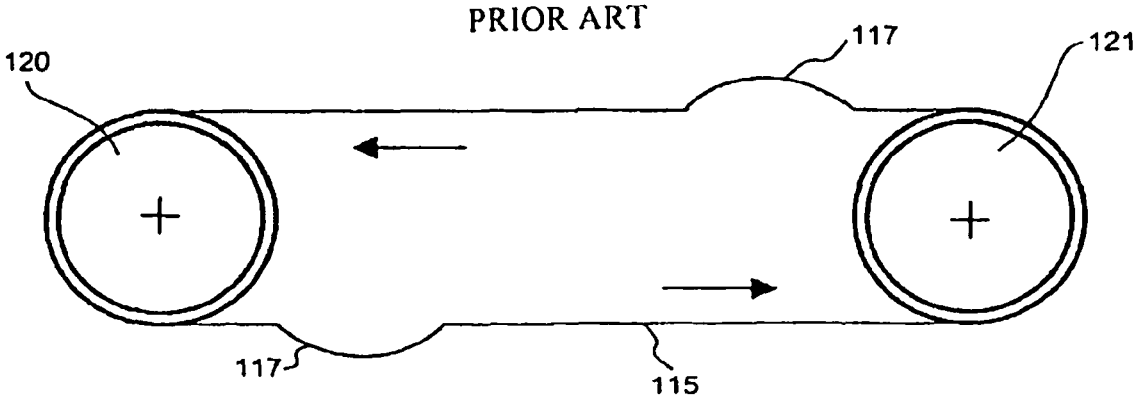
FIG.6 PRIOR ART
FIG. 6 is a schematic diagram of an intermediate transfer belt with imprinted marks.

FIG. 5 is a schematic diagram of a tandem image forming apparatus 200 according to a second embodiment of the present invention. The image forming apparatus 100 employs an intermediate transfer method while the image forming apparatus 200 employs a direct transfer method. In other words, the image forming apparatus 200 transfers an image from an image carrier directly onto a transfer sheet. The description of portions identical to those in the first embodiment is outlined briefly.

The image forming apparatus 200 includes a process unit 66 including four process units 66Y, 66C, 66M, and 66BK, an exposure unit 65, a transfer belt 62, four transfer rollers 68, a cleaning unit 70, a fixing unit 69. Each of the process units 66Y, 66C, 66M, and 66BK includes a photosensitive drum 61, a charging unit 64, and a developing unit 67 in an integrated manner. The transfer rollers 68 are respectively arranged to be opposed to the photosensitive drums 61 included in the process units 66Y, 66C, 66M, and 66BK across the transfer belt 62.

The photosensitive drum 61 rotates clockwise. A bias voltage is applied to a surface of the photosensitive drum 61 by the charging unit 64 having contact with the photosensitive drum 61, so that the surface of the photosensitive drum 61 is uniformly charged. After that, an electrostatic latent image corresponding to image data is formed on the surface of the photosensitive drum 61 by the exposure unit 65. The electrostatic latent image formed by the exposure unit 65 is developed into a toner image by passing through the developing unit 67. The toner images formed on the surfaces of the photosensitive drums 61 are sequentially transferred onto a transfer sheet 63 conveyed on the transfer belt 62 at a timing when the transfer sheet 63 passes through each of the photosensitive drums 61. At this time, the transfer roller 68 presses the transfer belt 62 against the photosensitive drum 61, and applies a bias voltage having a polarity opposite to that of the toner images to the transfer sheet 63 via the transfer belt 62. The transfer sheet 63 onto which the toner images are transferred is conveyed to the fixing unit 69 in accordance with a movement of the transfer belt 62. The fixing unit 69 fixes the toner images on the transfer sheet 63 by the application of heat and pressure. The transfer sheet 63 on which an image is formed is discharged from the image forming apparatus. The cleaning unit 70 removes residual toners and dirt such as paper dust from a surface of the transfer belt 62. In the image forming apparatus 200, the transfer belt 62 is tensed by two supporting rollers. Therefore, when the image forming apparatus is not in use for a long time, imprinted marks of the supporting rollers are left on the transfer belt 62. If an image is formed on an imprinted mark left on the transfer belt 62, density unevenness occurs in the print image regularly.

To take care of this issue, in the image forming apparatus 200, the contacting operation of the transfer belt 62 with the photosensitive drum 61 is repeated two times by a moving unit. By the extra contact movement of the transfer belt 62, the imprinted marks left on the transfer belt 62 can be made flat. Consequently, it is possible to reduce the density unevenness of the print image.

In the second embodiment, the second contacting operation is performed when an imprinted mark on the transfer belt 62 comes between the process units 66C and 66M. The imprinted marks of the supporting rollers are left on contact surfaces of the transfer belt 62 because the maximum tension is applied to the contact surfaces by the supporting rollers. Therefore, the first contacting operation is performed, the separating operation of separating the transfer belt 62 from the photosensitive drum 61 is performed, the transfer belt 62 is moved in the moving direction, and then the second contacting operation is performed. Namely, contact surfaces of the transfer belt 62 with the supporting rollers in the second contacting operation are different from those are in the first contacting operation, so that portions of the transfer belt 62 nearby the imprinted marks are tensed in the second contacting operation. Therefore, it is possible to recover the transfer belt 62 from the imprinted marks more effectively. As a result, it is possible to make the imprinted marks flat. Moreover, the transfer belt 62 is slightly moved in the moving direction after the first contacting operation, and stopped temporarily so that the supporting rollers can have enough time to tense the transfer belt 62. Even when it is only for three seconds that the transfer belt 62 is tensed by the supporting rollers, the imprinted marks can be made flat in an, effective manner.

In the second embodiment, the transfer belt 62 that is supported and tensed by two supporting rollers mainly is employed. It is also applicable to a case in which a transfer belt that is supported and tensed by three supporting rollers. In the same manner as the second embodiment, the transfer belt is stopped temporarily when the transfer belt moves a distance substantially corresponding to a semiperimeter of each of the supporting rollers, or is driven to move at low speed until the transfer belt moves up to the distance substantially corresponding to the semiperimeter of each of the supporting rollers between the first contacting operation and the second contacting operation.

In this manner, the image forming apparatus 200 can eliminate imprinted marks left on the transfer belt 62 with simple operation of the transfer belt 62. In addition, it is possible to reduce the cost and the size of the image forming apparatus.

The tandem image forming apparatus employing the intermediate transfer method in which the intermediate transfer belt 15 is supported in a horizontal direction so that Y, C, M, and BK toner images are transferred onto the intermediate transfer belt in one cycle and the tandem image forming apparatus employing the direct transfer method are explained above. It is also applicable to so-called a retract image forming apparatus that primarily-transfers toner images onto an intermediate transfer body sequentially in a superimposed manner, and secondarily-transfers the superimposed toner images on the intermediate transfer body onto a sheet in a batch, such as an image forming apparatus employing the intermediate transfer method and a revolver developing method.

In the above embodiments, the cleaning unit that cleans residual toners on the intermediate transfer belt or the transfer belt is fixed. Alternatively, a cleaning unit including a movable cleaning blade capable of moving to come in contact with or to be separated from a surface of the belt can be used.

In the above embodiments, the moving unit causes the intermediate transfer belt or the transfer belt to come in contact with or to be separated from the photosensitive drum. Alternatively, the moving unit can be configured to cause the photosensitive drum to come in contact with or to be separated from the intermediate transfer belt or the transfer belt. In this case, for example, the moving unit pushes a bearing of the photosensitive drum up or down so that the photosensitive drum comes in contact with or is separated from the intermediate transfer belt or the transfer belt.

According to an aspect of the present invention, when staring image formation, the contacting is repeated a plurality of times. As a result, raised marks, i.e., imprinted marks of supporting rollers left on the endless belt can be made flat. Thus, it is possible to reduce a density unevenness of a print image. Consequently, the image forming apparatus can form an image with high precision. In addition, the endless belt is supported by two supporting rollers, so that it is possible to reduce the cost and size of the image forming apparatus.

Moreover, a second contacting operation is performed when an imprinted mark on the endless belt is located near the supporting rollers where the maximum tension of the belt is obtained. Therefore, it is possible to effectively make the imprinted mark flat.

Furthermore, the endless belt is temporarily stopped between a first contacting operation and a second contacting operation. Therefore, it is possible to more effectively make the imprinted mark flat. Specifically, the endless belt is stopped temporarily after the endless belt moves a distance substantially corresponding to a semiperimeter of each of the supporting rollers. Therefore, it is possible to check a load torque due to the belt drive. In addition, it is possible to utilize the load torque.

Moreover, instead of temporarily stopping the endless belt, the endless belt is temporarily moved at a speed lower than a normal speed of the endless belt. Therefore, it is possible to shorten the processing time. Consequently, it is possible to improve the productivity. In addition, while the endless belt moves at the lower speed, a force applied to the supporting rollers in an axial direction is maximized. Therefore, it is possible to prevent the endless belt from meandering. Furthermore, it is possible to prevent the endless belt from being chipped or cracked, and also to prevent a misalignment of toner images on the endless belt. Moreover, it is possible to prevent the inner side of the endless belt from being chipped due to rotations of the supporting rollers. Therefore, it is possible to reduce a load of a start-up torque required for a motor or the like for driving the endless belt.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which a toner image is formed;

an endless belt that is supported by a plurality of supporting members;

a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving any one of the endless belt and the image carrier to cause the endless belt and the image carrier to be separated from each other; and a control unit that controls the moving unit, wherein the control unit controls the moving unit so as to perform the separating operation when an image is not to be formed on the image carrier, and controls the moving unit so as to perform, when an image is to be formed, the contacting operation a plurality of times before the transfer unit starts transferring the toner image.

2. The image forming apparatus according to claim 1, wherein the control unit controls the moving unit such that a contact portion of the endless belt with the image carrier in a first contacting operation from among the contacting operations is different from a contact portion of the endless belt with the image carrier in a subsequent contacting operation.

3. The image forming apparatus according to claim 2, wherein the supporting members are supporting rollers, and the control unit controls the moving unit to perform the contacting operation at a time when the endless belt has moved a distance corresponding to about a half of rotation of the supporting rollers.

4. The image forming apparatus according to claim 3, wherein the supporting rollers are two in number.

5. The image forming apparatus according to claim 3, wherein the supporting rollers are three in number.

6. An image forming apparatus comprising:

an image carrier on which a toner image is formed;

an endless belt that is supported by a plurality of supporting members;

a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving the endless belt and the image carrier to cause the endless belt and the image carrier to be separated from each other; and a control unit that controls the moving unit and movement of the endless belt, wherein the control unit, when an image is not to be formed on the image carrier, controls the moving unit so as to perform the separating operation, and when an image is to be formed, controls movement of the endless belt so as to temporarily stop the endless belt after the endless belt has moved a predetermined distance and then controls the moving unit so as to perform the contacting operation, before the transfer unit starts transferring the toner image.

7. The image forming apparatus according to claim 6, wherein the supporting members are supporting rollers, and the control unit controls movement of the endless belt so as to temporarily stop the endless belt after moving a distance corresponding to about a half of rotation of the supporting rollers.

8. The image forming apparatus according to claim 7, wherein the supporting rollers are two in number.

9. The image forming apparatus according to claim 7, wherein the supporting rollers are three in number.

10. An image forming apparatus comprising:

an image carrier on which a toner image is formed;

an endless belt that is supported by a plurality of supporting members;

a transfer unit that transfers the toner image from the image carrier to a recording member when the image carrier is in contact with the recording member, the recording member being any one of the endless belt and a recording medium carried by the endless belt; and a moving unit configured to perform a contacting operation including relatively moving the endless belt and the image carrier to cause the endless belt and the image carrier to come in contact with each other, and a separating operation including relatively moving the endless belt and the image carrier to cause the endless belt and the image carrier to be separated from each other; and a control unit that controls the moving unit and movement of the endless belt, wherein the control unit, when an image is not to be formed on the image carrier, controls the moving unit so as to perform the separating operation, and when an image is to be formed, controls movement of the endless belt so as to temporarily move the endless belt at a speed lower than normal speed of the endless belt and then controls the moving unit so as to perform the contacting operation, before the transfer unit starts transferring the toner image.

11. The image forming apparatus according to claim 10, wherein the supporting members are supporting rollers, and the control unit controls movement of the endless belt so as to temporarily move the endless belt at the lower speed for a distance corresponding to about a half of rotation of the supporting rollers.

12. The image forming apparatus according to claim 11, wherein the supporting rollers are two in number.

13. The image forming apparatus according to claim 11, wherein the supporting rollers are three in number.

* * * * *